United States Patent [19]

Bearden et al.

[11] 4,425,225

[45] Jan. 10, 1984

[54] REDUCING METAL CONTENT OF OIL FEEDS

[75] Inventors: Roby Bearden; Gordon F. Stuntz, both of Baton Rouge, La.

[73] Assignee: Exxon Research and Engineering Co., Florham Park, N.J.

[21] Appl. No.: 336,784

[22] Filed: Jan. 4, 1982

Related U.S. Application Data

[63] Continuation-in-part of Ser. No. 221,905, Dec. 31, 1980, abandoned.

[51] Int. Cl.[3] ..... C10G 17/06; C10G 29/10

[52] U.S. Cl. ..... 208/252; 208/251 R; 208/253; 208/348

[58] Field of Search ..... 208/251 R, 252, 253, 208/348

[56] References Cited

U.S. PATENT DOCUMENTS

| | | | |
|---|---|---|---|
| 2,009,710 | 7/1935 | Goodwin et al. | 208/252 |
| 2,411,958 | 12/1946 | Dietrich et al. | 208/251 |
| 2,926,129 | 2/1960 | Kimberlin | 208/86 |
| 2,969,320 | 1/1961 | Shapiro | 208/251 |
| 3,095,368 | 6/1963 | Bieber | 208/252 |
| 3,294,678 | 12/1966 | Gleim | 208/309 |
| 3,511,774 | 5/1970 | Long et al. | 208/251 |
| 4,035,287 | 7/1977 | Espenschied et al. | 208/242 |

FOREIGN PATENT DOCUMENTS 2031011 10/1978 United Kingdom .

OTHER PUBLICATIONS

The Oil and Gas Journal, May 5, 1972, "Deposited Metals Poison FCC Catalyst", Ambalo et al.

*Primary Examiner*—Delbert E. Gantz
*Assistant Examiner*—Helane E. Maull
*Attorney, Agent, or Firm*—Edward H. Mazer

[57] ABSTRACT

A method for reducing the metal contaminant concentration in a petroleum fraction containing an asphaltene component and a metal contaminant is disclosed. The petroleum feedstock is contacted with vapor phase $SO_2$ or a vapor phase $SO_2$ precursor at an elevated temperature after which the petroleum fraction is deasphalted. The petroleum fraction is separated into a first fraction relatively lean in the asphaltene component and the metal contaminant and a second phase relatively rich in the asphaltene component and the metal contaminant.

18 Claims, 4 Drawing Figures

REDUCING METAL CONTENT OF OIL FEEDS

CROSS-REFERENCE TO RELATED APPLICATIONS

This application is a Continuation-in-Part of U.S. patent application Ser. No. 221,905 filed on Dec. 31, 1980, now abandoned.

BACKGROUND OF THE INVENTION

The present invention generally relates to the removal of metallic contaminants from petroleum fractions. Specifically, the present invention relates to the removal of complex organo-metallic compounds, for example, of the porphyrin type, and particularly those compounds containing nickel and vanadium from residua by deasphalting. In petroleum processing operations such as catalytic cracking the presence of these metallic contaminants in the petroleum feed, e.g., in a deasphalted oil, leads to rapid catalyst contamination by metals causing an undesirable increase in the hydrogen and coke makes, a loss in gasoline yield, a loss in conversion activity and a decrease in the catalyst life. The metal contaminant concentration generally is higher in the heavier feedstocks. Thus, the removal of metal contaminants is becoming more important as increasingly heavy feedstocks are being refined and as additional efforts are being directed at upgrading the residual petroleum fractions.

In the past, efforts have been directed at the removal of metal contaminants from petroleum fractions by a variety of methods including deasphalting processes, hydrotreating processes and HF extraction. U.S. Pat. No. 2,926,129 is directed at the removal of organometallic compounds and the deasphalting of a petroleum fraction by heating the petroleum fraction at a temperature of 650°–850° F. for 0.1 to 5 hours after which the fraction is contacted with an acidic material soluble in the petroleum fraction, such as HCl, to coagulate the metallic contaminants. A sludging component, such as a liquid $SO_2$ is then added to the petroleum fraction at the rate of 0.1 to 3 volumes of $SO_2$ per volume of oil to promote precipitation of the asphaltene. A solvent also is added to the fraction preferably at the rate of 0.1 to 10 volumes per volume of oil to separate the asphaltene sludge fraction in a fractionating tower operated at temperatures of 30° to 300° F. and pressures of 25 to 300 psig. This patent also discloses in a table in column 5 that a less effective reduction in metals content in the recovered oil may be accomplished utilizing the solvent and liquid $SO_2$, without the acid. Use of the process described in this patent is not desirable since relatively large quantities of sulfur dioxide in the liquid state are required, which necessitates operating at high vessel pressures if high temperatures are used and may necessitate the removal of the $SO_2$ from the recovered oil and from the sludge. Moreover, addition of an acid, such as HCl would require that the processing equipment be acid resistant. Furthermore, the pressure of halogen compounds in the system increases the potential for downstream corrosion, particularly if water should be present. In addition, the presence of acidic compounds in the recovered oil would be injurious to catalysts used in subsequent processing.

U.S. Pat. No. 3,294,678 is directed at a deasphalting process for the separation and removal of asphaltenic material including organo-metallic complexes of nickel and vanadium which comprises treating the petroleum fraction with an alkalinous bisulfide or bisulfite in aqueous solution under a pressure in the range of 150 to 2000 psig in the presence of sufficient sulfur dioxide such that the partial pressure of the sulfur dioxide is within the range of about 150 to about 1500 psig. The asphaltenic material including organo-metallic compounds is converted into a water-soluble sulfonic acid salt which is subsequently extracted. This process is not desirable because of the additional steps of separating the water fraction from the petroleum fraction and separating the sulfonic acid salts from the asphaltenic material.

U.S. Pat. No. 2,969,320 discloses a method for removing tetraethyl lead from gasoline and other hydrocarbon liquids by injecting sulfur dioxide into the liquid to form an insoluble lead sulfide which may subsequently be removed by filtration. This method does not disclose or suggest removal of metals such as nickel and vanadium from petroleum fractions by heating in the presence of sulfur dioxide prior to deasphalting.

U.S. Pat. No. 3,095,368 describes a method for selectively removing iron, nickel and vanadium from an asphaltic petroleum feedstock by deasphalting the oil and subsequently contacting the oil with a mineral acid to coagulate the metallic compound. The metallic compounds are then separated. This process requires the use of mineral acids which are corrosive and requires additional processing steps.

In a paper presented at the 1980 meeting of the Division of Petroleum Chemistry of the American Chemical Society, Bukowski and Gurdzinska disclosed a method for reducing the adverse catalytic effect of metal contaminants present in the distillate from atmospheric residuum. The method included the heat treating of the atmospheric residuum in the presence of cumene hydroperoxide (CHP) for up to six hours at 120° C. This step increased the distillate fraction obtained from the atmospheric residuum feed and decreased the metals content of the distillate which subsequently was used as feed for a catalytic cracking unit. This procedure is not advantageous due to the relatively high cost of the CHP required and the long treatment times involved.

British Patent Application No. 2,031,011 describes a method for reducing the metals and asphaltene content of a heavy oil by hydrotreating the oil in the presence of a catalyst including a metal component from Group Ib, IIb, IIIa, Va, VI, and VIII of the Periodic Table followed by deasphalting. This process is not preferred since relatively large quantities of hydrogen are required in addition to a large investment in hydrotreating reactors and process equipment.

Accordingly, it is desirable to provide a process which reduces the metals concentration in a petroleum fraction to sufficiently low levels without the addition of large amounts of acidic materials. It also is desirable to provide a process in which the metals content of a petroleum fraction is reduced without the addition of a halogenated compound.

It also is desirable to provide a process which does not require the further addition of a metal rejection agent to the deasphalting zone.

It is also advantageous to provide a process which will reduce the metals concentration in the petroleum fraction without an excessive amount of equipment and without the addition of a large number of additional processing operations to recover the metals rejection agent.

SUMMARY OF THE INVENTION

The subject invention is directed at a method for reducing the metal contaminant concentration in a petroleum fraction containing the metal contaminant and an asphaltenic component comprising the steps of:

A. passing the petroleum fraction into a contacting zone maintained at an elevated temperature and contacting the petroleum fraction therein with an effective amount of one or more metal rejection agents selected from the group consisting of sulfur dioxide in the vapor phase and precursors of vapor phase sulfur dioxide including sulfurous acid, ammonium bisulfite and alkali metal bisulfites to thereby cause at least a portion of the metal contaminant to separate with the asphaltenic material;

B. passing the petroleum fraction from the contacting zone to a deasphalting zone wherein the petroleum fraction is contacted with a deasphalting agent to form a first fraction relatively lean in the asphaltenic component and in metal contaminant and a second fraction relatively rich in asphaltenic component and metal contaminant; and C. separating the first fraction from the second fraction.

In a preferred embodiment the petroleum fraction, comprising atmospheric distillation column bottoms, is passed into a contacting zone maintained at a temperature ranging between about 200° C. and 450° C. for about 0.01 to about 5 hours, said contact time varying inversely with temperature in the presence of about 0.5 to about 5.0 weight percent sulfur dioxide in the vapor phase, based upon the weight of the petroleum fraction. The petroleum fraction is then contacted in a deasphalting zone with an effective amount of a deasphalting agent or solvent such as propane, butane, pentane or hexane and then separated into a first fraction relatively lean in asphaltene and metal contaminant and a second fraction relatively rich in asphaltene and metal contaminants. Solvent from said first and second fractions preferably is recovered and recycled to the deasphalting zone.

For example, when propane is used as the solvent, the solvent to feed ratio typically ranges from about 2:1 to 6:1. The actual solvent to feed ratio used will be a function of the solvent and the feed characteristics. These ratios are known by those skilled in the art.

DETAILED DESCRIPTION OF THE INVENTION

Figure 1:
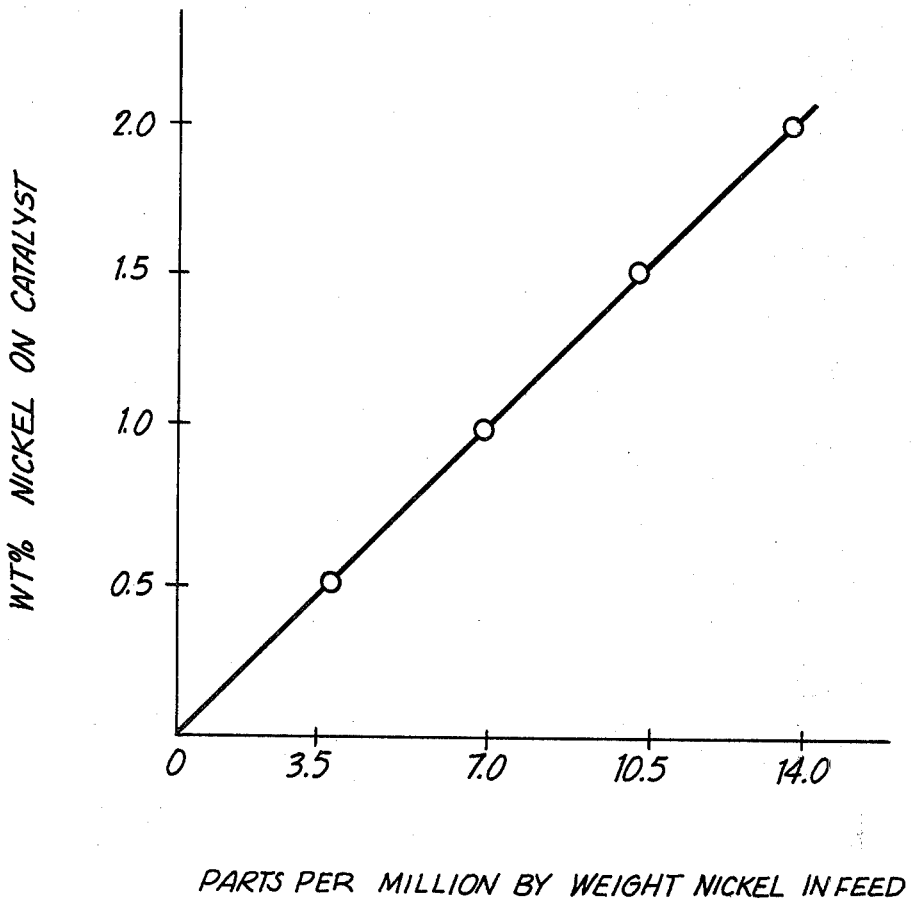
FIG. 1 is a plot of the equilibrium weight percent of the nickel on cracking catalyst as a function of the parts per million of nickel in the feed at typical fluid catalytic cracking conditions.
Figure 3:
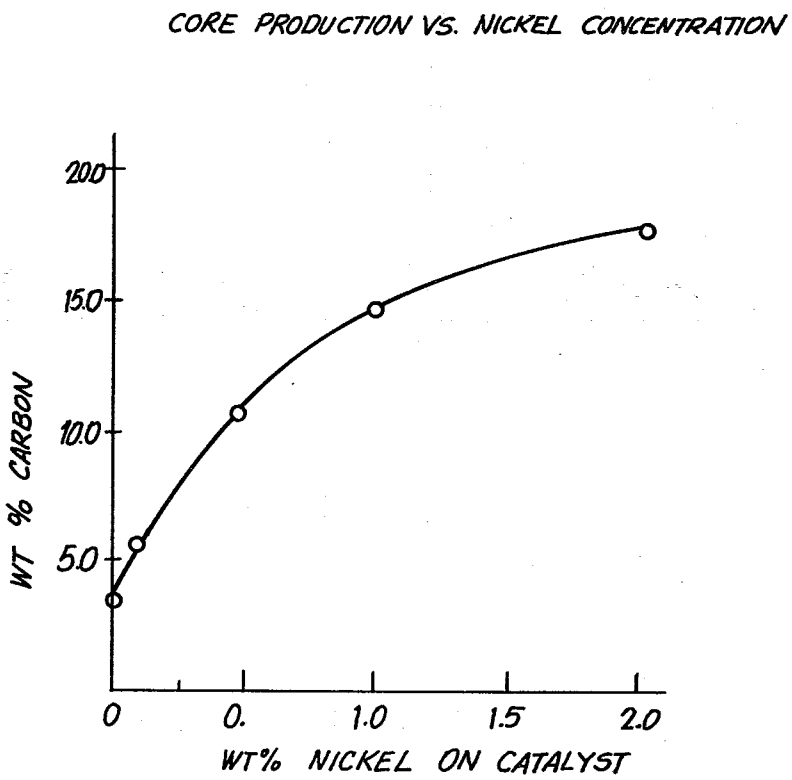
FIG. 3 is a plot of the weight percent of the feed which is converted to coke as a function of the nickel content on the catalyst under typical catalytic cracking operating conditions.
Figure 2:
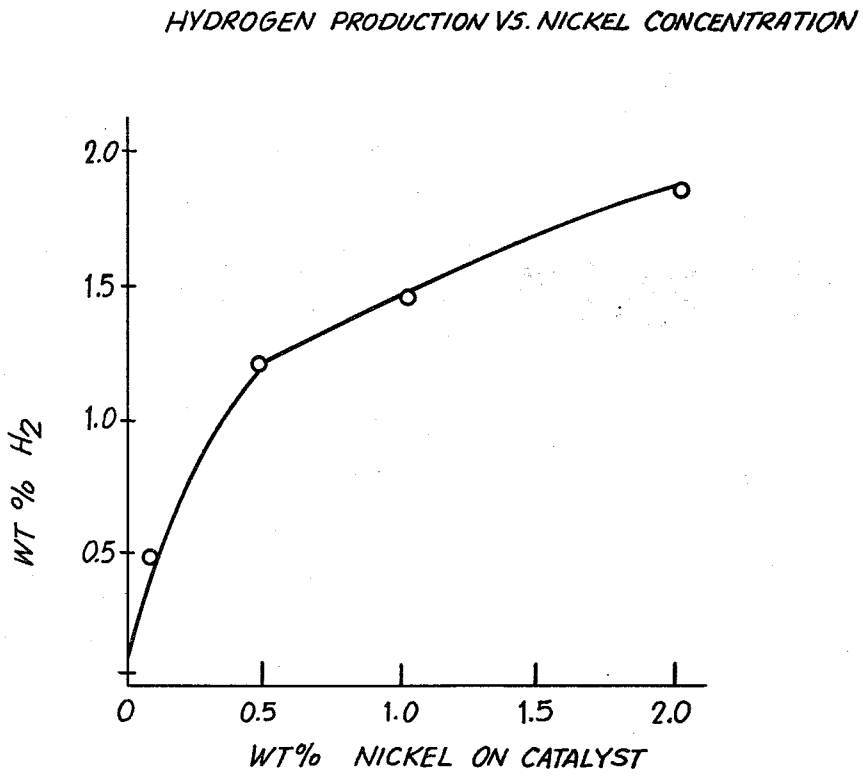
FIG. 2 is a plot of the weight percent of the feed which is converted to hydrogen as a function of the nickel content of the catalyst under typical catalytic cracking conditions.

FIGS. 1–3 graphically illustrate the importance of reducing the nickel and vanadium content of catalytic cracking feedstocks. Generally, vanadium is considered to exhibit about one-quarter of the adverse catalytic effect of nickel on a weight equivalent basis. The adverse catalytic effect of nickel and vanadium is discussed in an article by Cimbalo, Foster and Wachtel in "Oil and Gas Journal" May 15, 1972, pages 112–122, the disclosure of which is incorporated herein by reference.

FIG. 1 illustrates the relationship between the nickel content of the feed and the corresponding nickel content of the catalyst under typical cat cracking conditions. FIG. 2 illustrates the weight percent of the feed converted to hydrogen as a function of the nickel concentration of the catalyst. FIG. 3 illustrates the weight percent of the feed converted to coke as a function of the nickel content on the catalyst. While FIGS. 1, 2, and 3 are directed at the detrimental effects of nickel on hydrogen and coke production, vanadium and other metals, such as iron and copper may also be present in petroleum fractions. These metals are less catalytically active, but also may contribute to excessive hydrogen and coke production. As used herein the term "metal contaminant" is defined to include all of the aforementioned metals. In the data shown in FIGS. 2 and 3 a commercially available silica-alumina zeolite catalyst sold under the tradename CBZ-1, manufactured by Davison Division, W. R. Grace and Company was used. Tests were run using a microcatalytic cracking (MCC) unit. The MCC unit comprised a captive fluidized bed of catalyst kept at a cracking zone temperature of 500° C. Tests were run by passing a vacuum gas oil having a minimum boiling point of about 340° C. and a maximum boiling point of about 565° C. through the reactor for two minutes and analyzing for hydrogen and coke production. It can be seen that as the nickel concentration on the catalyst increases, the undesired hydrogen and coke yields also increase. Thus, it can be appreciated that a process which would provide a cat cracking feedstock of lower metals content would be particularly useful.

Figure 4:
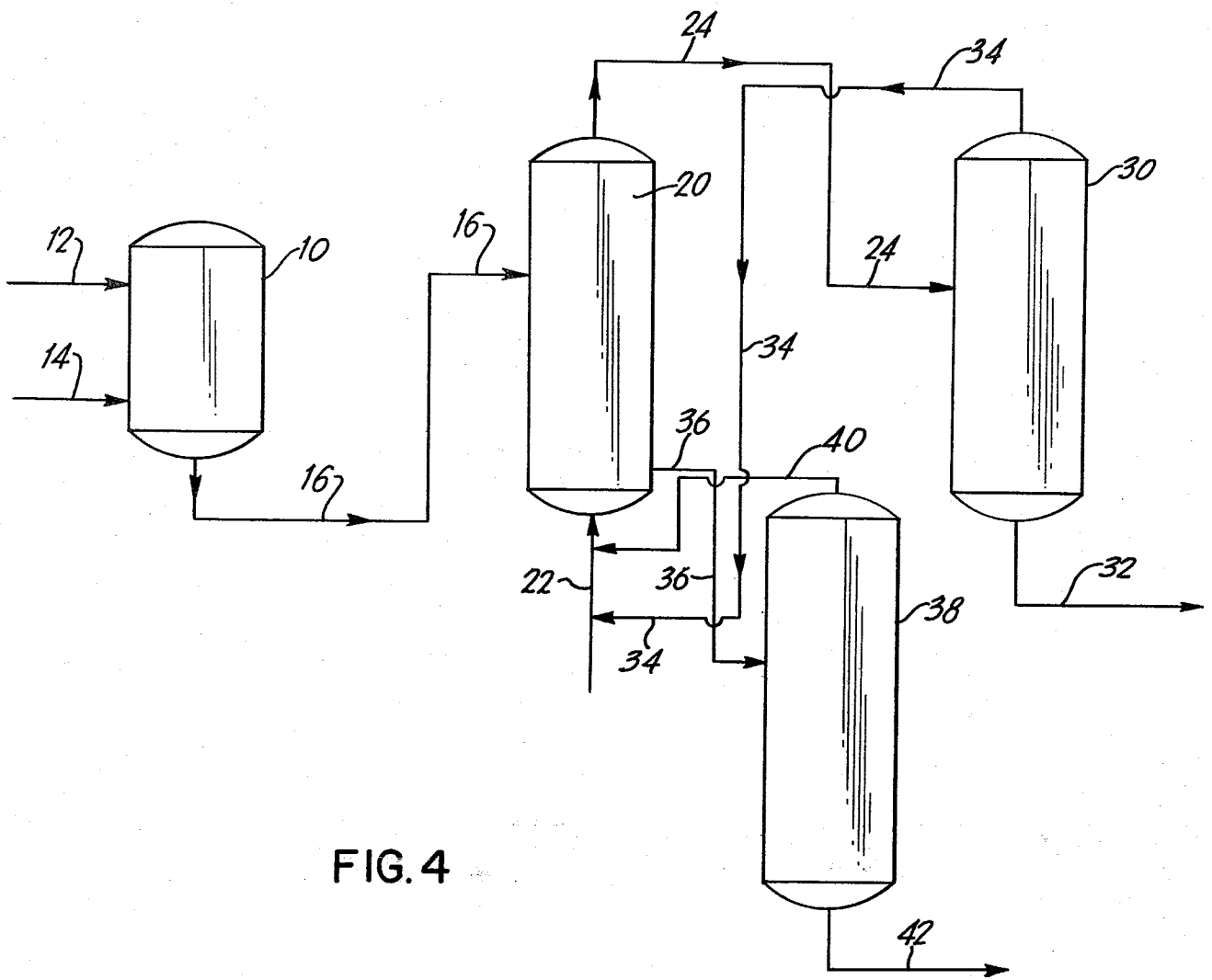
FIG. 4 is a simplified process flow diagram illustrating one method for practicing the subject invention.

Referring to FIG. 4, one method for practicing the subject invention is shown. In this figure valves, pumps, piping, instrumentation and equipment not essential to the understanding of the subject invention have been eliminated for clarity. A petroleum fraction is shown entering contacting zone 10 through line 12. A metals rejection agent is added to zone 10 through line 14. Typically contacting zone 10 will comprise a process vessel whose size is a function of the feed rate through line 12 and the desired residence time. After the requisite residence time in zone 10, the petroleum fraction is transferred through line 16 to a deasphalting zone 20 which comprises a countercurrent mixing tower, in which the petroleum fraction is contacted with a solvent entering through line 22 to form a first fraction relatively lean in metal contaminant and asphaltene and a second fraction relatively rich in metal contaminant and asphaltene. The first fraction comprising a deasphalted oil and solvent mixture is then transferred from the top of tower 20 through line 24 to a separation zone 30, comprising a flash distillation tower, in which the mixture is separated into a deasphalted oil fraction relatively low in asphaltenic and metal conpounds exiting zone 30 through line 32 and a solvent fraction which exits zone 30 through line 34 and is recycled to zone 20 through line 22. The second fraction comprising a molten asphaltene fraction containing a small amount of solvent is withdrawn from the bottom of tower 20 and fed via line 36 to flash separation zone 38 wherein the mixture is separated into an asphalt stream, exiting through line 42, and a solvent stream which is returned via lines 40 and 22 to mixing zone 20. The operating conditions for deasphalting operations are dependent upon the type of solvent, solvent to oil ratio and the characteristics of the feedstock to the deasphalting operation. These variables are known by those skilled in the art. A discussion of deasphalting operations in general may be found in *Advances in Petroleum Chemistry and Refining*, Volume 5, pp. 284–291, John Wiley and Sons, New York, New York (1962), the disclosure of which is incorporated herein by reference.

The composition of the petroleum feedstock passed into contacting zone 10 is not critical. Typically this will comprise the bottoms from an atmospheric distillation having an atmospheric boiling point of above about 285° C. which has a total elemental metal contaminant content ranging between about 1 and about 2000 parts per million by weight (WPPM), although other feedstocks having high metal content may also be used. To avoid unnecessary product contamination as well as to minimize costs, the amount of metal rejection agent used should be the lowest amount which will give effective results at the desired operating conditions. The amount of metal rejection agent required will be a function of the specific agent used and the metal content of the feed. The metal rejection agent, selected from the group consisting of vapor phase sulfur dioxide and precursors of vapor phase sulfur dioxide such as sulfurous acid, ammonium bisulfite and alkyl metal bisulfites, preferably is a non-halogen compound. The most preferred compound based upon cost and effectiveness is sulfur dioxide. Typically, the concentration of $SO_2$ added to the high metals feed will range from about 0.5 to about 5.0 wt. % of the feed, preferably about 1 to about 3 wt. percent. If a precursor of $SO_2$ is used, the precursor concentration should be sufficient to furnish $SO_2$ concentrations of from 0.5 to 5.0 wt. % of the feed, and preferably 1–3 wt. % of the feed.

The residence time of the petroleum fraction in contacting zone 10 must be sufficient to provide adequate contacting between the metal rejection agent and the petroleum fraction. The residence time in zone 10 is a function of the specific metal rejection agent utilized, the process conditions in zone 10 and the metal contaminant content of the petroleum fraction. Typically, the contacting time in zone 10 ranges between 0.01 and 5 hours. The temperature in zone 10 is above the critical temperature of $SO_2$, approximately 157.7° C. and typically may range between about 200° C. and about 450° C., preferably between about 300° C. and about 400° C. while the pressure may range between about 20 and about 400 psig, preferably between about 50 and about 200 psig. The temperature in deasphalting zone 20 generally may range between about 25° and 250° C., while the pressure may range between about 0 and 600 psig. The deasphalting agent or solvent added may be any solvent effective for deasphalting the petroleum fraction. Typically, an organic solvent, preferably an alkane, is added to mixing zone 20 in a ratio of solvent to petroleum fraction of from about 1:1 to about 20:1 by volume. Among the preferred alkane solvents are propane, butane, pentane and hexane, with the most preferred being propane. Deasphalting zone 20 may comprise conventional mixing equipment such as a countercurrent contacting tower. Separation zones 30 and 38 comprise means by which the deasphalted oil and asphaltene fractions, respectively, are separated from solvent. Typically these separation zones comprise flash distillation towers. The operating conditions for separation zones 30 and 38 are well known by those skilled in the art. When propane is used as the deasphalting agent, the pressure in separation zones 30 and 38 typically ranges between about 250 and about 300 psig. The temperatures in zone 30 typically may range between 150° and 175° C., while the temperature in zone 38 may range between about 225° C. and about 325° C. It should be noted that the process described herein reduces the metal content of the petroleum fraction utilizing relatively small quantities of a non-halogen containing metal rejection agent.

The following examples demonstrate the effectiveness of the subject invention in reducing the metals content from a deasphalted petroleum fraction. Comparative experiments were conducted using as the feedstock a Tia Juana atmospheric residuum having an initial boiling point of about 260° C., a nickel content of 34 parts per million by weight (wppm) and a vanadium content of 273 wppm. In these examples 300 g of the Tia Juana residuum was charged to a one liter Hastelloy-C autoclave with 6.3 g (2.1 wt. % on feed) of gaseous sulfur dioxide. The autoclave then was heated to about 340° C. for stirred contact for the indicated time during which time the pressure reached about 125 psig. Upon cooling to 150° C., the pressure was released and the autoclave was flushed with nitrogen while cooling further to room temperature. The resultant treated residuum was contacted with 16 volumes of pentane per volume of residuum, mixed for 0.5 hours at 60° C. in a stirred autoclave and then cooled to room temperature. The resulting mixture was filtered using a #2 Whatman paper to recover an asphaltene fraction relatively rich in asphaltene and metal and a deasphalted oil fraction relatively lean in asphaltene and metal. The results of these experiments for sulfur dioxide pretreatments of 60 and 100 minutes are shown in Table 1 below designated as samples 1 and 2, respectively. Sample 3 of Table 1 illustrates that when the same petroleum feedstock did not have the aforementioned sulfur dioxide pretreatment prior to deasphalting in a manner similar to that of samples 1 and 2, the resulting deasphalted oil had a higher metals content.

TABLE 1

EFFECT OF $SO_2$ PRETREATMENT ON METALS REJECTION

| Sample No. | 1 | 2 | 3 |
|---|---|---|---|
| Sulfur Dioxide Pretreatment Time (Minutes) | 60 | 100 | 0 |
| Deasphalted Oil; Wt. % on Feed | 86.2 | 83.1 | 90.2 |
| Deasphalted Oil Metal Contents | | | |
| WPPM Ni | 3.5 | 5.2 | 9.4 |
| WPPM V | 28.4 | 42.3 | 72.4 |

From Table 1 it may be seen that the $SO_2$ pretreatment step resulted in a decreased yield of deasphalted oil, but the resulting deasphalted oil had a substantial reduction in metals content for a 60 minute and a 100 minute pretreatment as compared with no pretreatment.

Another test was conducted on an identical sample of Tia Juana atmospheric residuum to determine if the heat treatment step would be effective in reducing the metals content in deasphalted oil if sulfur dioxide in the vapor phase were not present during the heat treating step. Both samples were heat treated for the same time and were deasphalted in a similar manner. As shown in Table II below, heat treating alone did not reduce the metals content of the deasphalted oil significantly.

TABLE II

| EFFECT OF PRETREATMENT ON METALS REJECTION | | |
|---|---|---|
| Sample No. | 1 | 4 |
| Pretreatment time @ 343° C., Min. | 60 | 60 |
| Wt. % $SO_2$ on feed | 2.1 | 0 |
| Deasphalted Oil; wt. % on feed | 86.2 | 89.6 |
| Deasphalted Oil Metal Content | | |
| WPPM Nickel | 3.5 | 10.0 |
| WPPM Vanadium | 28.4 | 85.0 |

It should be noted that the atmospheric residuum used in these tests contained organo-sulfur compounds. Thus, the presence of organo-sulfur compounds in the petroleum feedstock processed even in combination with heat treatment is ineffective in significantly reducing the metals content of deasphalted oil.

While the invention has been described with respect to a specific embodiment, it will be understood that this disclosure is intended to cover any variations, uses or adaptations of the invention including such departures from the present disclosure as come within known or customary practice in the art to which the invention pertains and as fall within the scope of the invention.

What is claimed is:

1. A method for reducing the metal contaminant concentration in a petroleum fraction containing the metal contaminant and an asphaltene component which comprises:

A. contacting the petroleum fraction in a contacting zone with a metal rejection agent selected from the group consisting of sulfur dioxide in the vapor phase and precursors of vapor phase sulfur dioxide at a temperature above the critical temperature of sulfur dioxide and at a pressure ranging between about 20 and about 400 p.s.i.g. such that the concentration of sulfur dioxide in the contacting zone will range from about 0.5 to about 5.0 wt.% of the petroleum fraction;

B. passing the petroleum fraction from the contacting zone to a deasphalting zone where the petroleum fraction is contacted with a deasphalting agent to form a first fraction relatively lean in the asphaltene component and metal contaminant and a second fraction relatively rich in the asphaltene component and metal contaminant; and C. separating the first fraction from the second fraction.

2. The method of claim 1 wherein the pressure in the contacting zone is maintained between about 50 and about 200 p.s.i.g.

3. The method of claim 1 wherein the temperature in the contacting zone is maintained between about 200° C. and about 450° C.

4. A method for reducing the metal contaminant concentration in a petroleum fraction containing the metal contaminant and an asphaltene component which comprises:

A. contacting the petroleum fraction in a contacting zone with a metal rejection agent selected from the group consisting of sulfur dioxide in the vapor phase and precursors of vapor phase sulfur dioxide at a pressure ranging between about 20 and about 400 p.s.i.g. and a temperature above the critical temperature of sulfur dioxide such that the concentration of sulfur dioxide in the contacting zone will range from about 0.5 to about 5.0 wt.% of the feed;

B. passing the petroleum fraction from the contacting zone to a deasphalting zone where the petroleum fraction is contacted with an alkane deasphalting agent to form a first fraction relatively lean in the asphaltene component and metal contaminant and a second fraction relatively rich in the asphaltene component and metal contaminant; and C. separating the first fraction from the second fraction.

5. The method of claim 4 wherein the deasphalting step is conducted in the deasphalting zone without the further addition of a metal rejection agent directly into the deasphalting zone.

6. The method of claim 5 wherein the deasphalting step is conducted in the deasphalting zone without the further addition of a halogenated compound to the deasphalting zone.

7. The method of claim 4 wherein the temperature of the contacting zone is maintained between about 200° C. and 450° C.

8. The method of claim 7 wherein the pressure in the contacting zone is maintained between about 20 and 400 psig.

9. The method of claim 8 wherein the temperature of the contacting zone is maintained between about 300° C. and about 400° C.

10. The method of claim 9 wherein the pressure in the contacting zone is maintained between about 50 and 200 psig.

11. The method of claim 8 wherein the effective concentration of sulfur dioxide in the contacting zone is maintained between about 1 and about 3 wt. % based upon the weight of petroleum fraction.

12. The method of claim 8 wherein the residence time of the petroleum fraction in the contacting zone ranges between about 0.01 hours and about 5 hours.

13. The method of claim 10 wherein the metal rejection agent is sulfur dioxide.

14. The method of claim 12 wherein the metal rejection agent is selected from the group of precursors of vapor phase sulfur dioxide consisting of sulfurous acid, ammonium bisulfite and alkali metal bisulfites.

15. The method of claim 13 wherein about 1 to about 20 volumes of deasphalting agent per volume of the petroleum fraction are added to the petroleum fraction.

16. The method of claim 13 wherein the deasphalting agent is selected from the group of alkanes consisting of propane, butane, pentane and hexane.

17. The method of claim 14 wherein the deasphalting agent is pentane.

18. A method for reducing the metal contaminant concentration in a petroleum fraction containing the metal contaminant and an asphaltene component comprising the steps of:

A. contacting the petroleum fraction with about 0.5 to about 5.0 wt. % $SO_2$ vapor based upon the weight of the petroleum fraction in a contacting zone maintained at a temperature ranging between about 200° C. and about 450° C. and a pressure ranging between about 20 psig and about 400 psig for a period of time ranging between about 0.01 and about 5 hours;

B. passing the petroleum fraction from the contacting zone to a deasphalting zone and contacting the petroleum fraction therein with about 1 to about 20 volumes of a deasphalting agent per volume of petroleum fraction where the deasphalting agent is selected from the group consisting of propane, butane, pentane and hexane to form a first fraction relatively lean in the metal contaminant and the asphaltene component and a second fraction relatively rich in the metal contaminant and the asphaltene component; and C. separating the first fraction from the second fraction.

* * * * *